US006270075B1

(12) United States Patent
Korhonen et al.

(10) Patent No.: US 6,270,075 B1
(45) Date of Patent: Aug. 7, 2001

(54) VACUUM TRANSPORT FOR USE IN A XEROGRAPHIC PRINTER

(75) Inventors: John V. Korhonen, Rickmansworth; Peter A. Mayfield, Hemel Hempstead; Colin Partridge, Baldock; Simon Muggleworth, Biggleswade, all of (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/603,543

(22) Filed: Jun. 26, 2000

(51) Int. Cl.[7] ..... B65H 5/02
(52) U.S. Cl. ..... 271/276; 271/194; 271/196
(58) Field of Search ..... 271/276, 194, 271/196, 94, 188

(56) References Cited

U.S. PATENT DOCUMENTS

| | | | | |
|---|---|---|---|---|
| 4,889,331 | * | 12/1989 | Sardella | 271/94 X |
| 5,127,329 | * | 7/1992 | DeMoore et al. | 271/194 X |
| 5,344,133 | * | 9/1994 | Jantsch et al. | 271/94 |
| 5,520,382 | * | 5/1996 | Nakajima | 271/188 |

* cited by examiner

*Primary Examiner*—David H. Bollinger
(74) *Attorney, Agent, or Firm*—R. Hutter

(57) ABSTRACT

A vacuum transport for a printer or copier guides a sheet through a machine, such as from a photoreceptor toward a fuser. The vacuum transport includes a partially enclosed vacuum chamber having rollers rotatably mounted therein. Portions of the rollers protrude through openings in the top of the chamber. A series of ribs are disposed between the openings. Some of the ribs extend diagonally toward one end of the width of the paper path over the transport.

17 Claims, 4 Drawing Sheets

VACUUM TRANSPORT FOR USE IN A XEROGRAPHIC PRINTER

FIELD OF THE INVENTION

The present invention relates to a vacuum transport for moving sheets, such as paper sheets, within a xerographic printing apparatus, such as a copier or "laser printer."

BACKGROUND OF THE INVENTION

Electrostatographic or xerographic printing devices, such as copiers or digital "laser printers," are well known. In many types of apparatus, a key area from a reliability standpoint is the zone between the charge-retentive member, such as a photoreceptor, and the fuser. The sheet that receives an image from the photoreceptor in a transfer step must be pulled from the photoreceptor (which is typically in the form of a rotating drum or belt) and, as smoothly as possible, directed to a fuser, which typically comprises two rollers forming a nip therebetween. The length of the gap between the photoreceptor and the fuser is crucial when the machine is handling short sheets as the photoreceptor may not ensure continuous drive to deliver the sheet to the fuser, causing a paper jam. If the sheet is caused to jam very close to the fuser, heat from the fuser is liable to create a dangerous situation. Further, because the toner image on the sheet as it passes from the photoreceptor to the fuser is only loosely attached to the sheet, any irregularities in the paper feeding between the photoreceptor and the fuser are likely to cause unacceptable smearing of the image.

In many designs of copiers or printers, particularly of the high-speed variety, the preferred device for moving a sheet from the photoreceptor to the fuser is a vacuum transport. A typical design of a vacuum transport is shown in FIG. 4. As shown in the Figure, the vacuum transport generally indicated as 100 is disposed within a copier or printer between a photoreceptor 102 and the fuser rolls 104. Vacuum transport 100 itself typically comprises a belt 110 which is entrained about two rollers 112, 114. This belt 110 typically defines a number of small holes therein (not shown). Disposed inside the belt 110 is a vacuum chamber 116. The vacuum chamber 116 is an actuated by a motor (not shown) and thereby draws air through the holes in belt 110 particularly in the area where a sheet moving in a process direction in is passing over the belt 110. In this way, vacuum chamber 116 holds a sheet against the outer surface of belt 110, while belt 110 moves that sheet from photoreceptor 100 toward the nip of fuser rolls 104.

While the vacuum transport of the general design shown in the Figure has long been proven to be effective, it suffers from various impracticalities. For instance, transport 100 tends to be heavy and expensive, and the belt 110 may require replacement over the life of the machine. The large size of the vacuum transport tends to preclude its use in compact printers and copiers. The present invention is directed toward a small, low-cost, yet effective vacuum transport.

SUMMARY OF THE INVENTION

The present invention is a vacuum transport for conveying a sheet in a process direction within a printing apparatus. A chamber defines an external surface, the external surface defining a full width perpendicular to the process direction. A first plurality of openings is defined in the external surface. A first plurality of ribs protrude from the external surface, the ribs being disposed between pairs of openings of the first plurality of openings, the ribs being oriented along the process direction. An axle is rotatably mounted within the chamber, and a plurality of rollers are disposed on the axle, whereby a portion of each roller protrudes through one of the first plurality of openings, and a gap is defined between a surface of each roller and an edge of the opening.

DETAILED DESCRIPTION OF THE INVENTION

Figure 1:
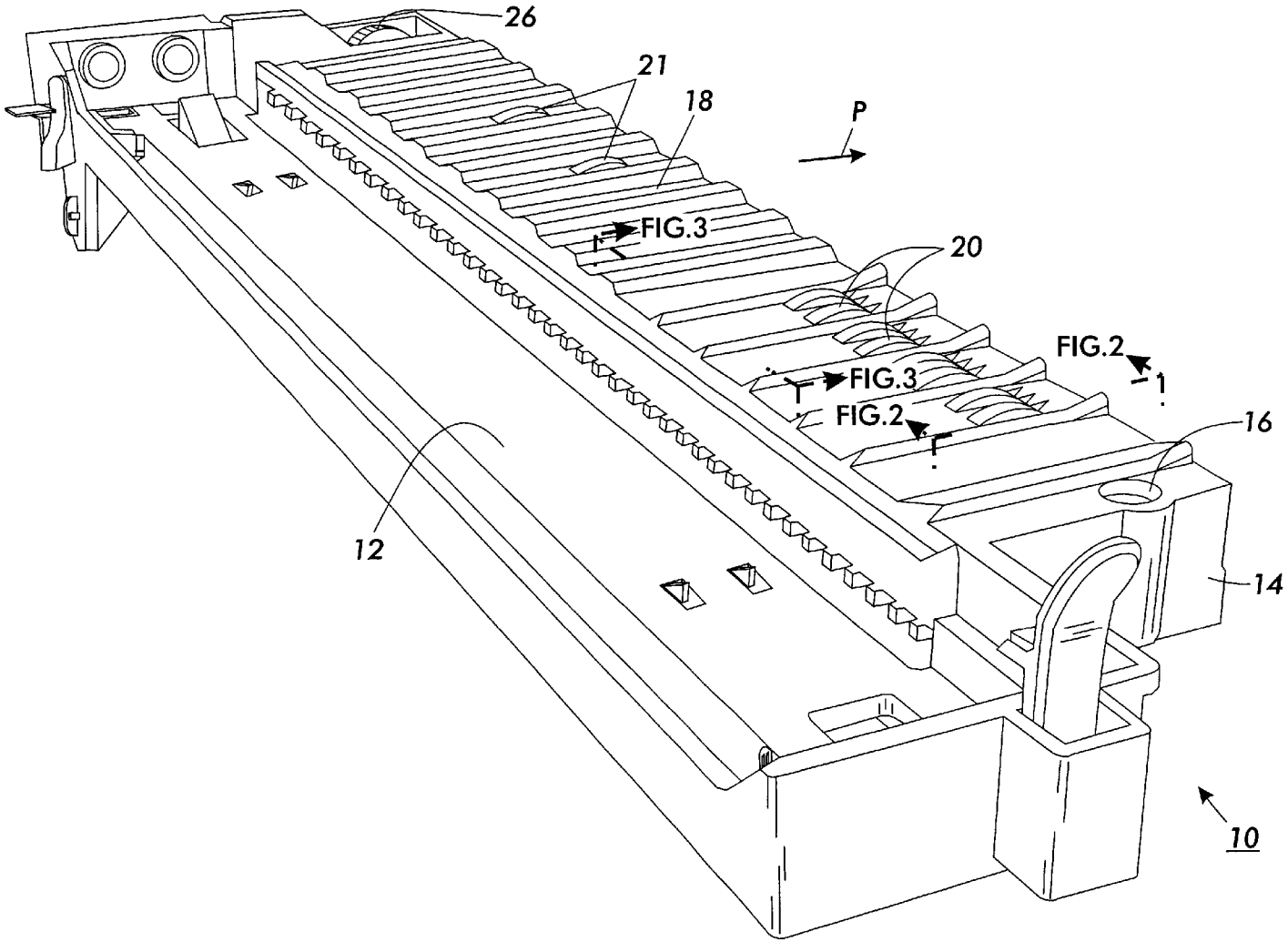
FIG. 1 is a perspective view showing, in isolation, a module including the main portions of a vacuum transport according to the present invention.

FIG. 1 shows, in isolation, a module including the vacuum transport according to a preferred embodiment of the present invention. The module is shown generally as 10. In a preferred embodiment of the present invention, the module 10 further includes a tray 12 for accommodating a corotron, such as to enable transfer of electrostatic images from a photoreceptor, but this corotron is not immediately germane to the present invention. Disposed next to the tray 12 is vacuum chamber 14. Chamber 14 communicates with a source of vacuum pressure (not shown) through an opening 16. Chamber 14 is generally enclosed, and extends a full width of a paper path through which sheets pass through the printing apparatus, such as through a process direction P shown in the Figure.

While chamber 14 is a generally enclosed chamber, the main external surface of the chamber 14, indicated as surface 18, forms the surface over which sheets passing from a photoreceptor to a fuser slide. As with the basic prior art design of a vacuum transport, it is generally intended that sheets be held against this surface 18 while passing from the photoreceptor to the fuser.

Figure 2:
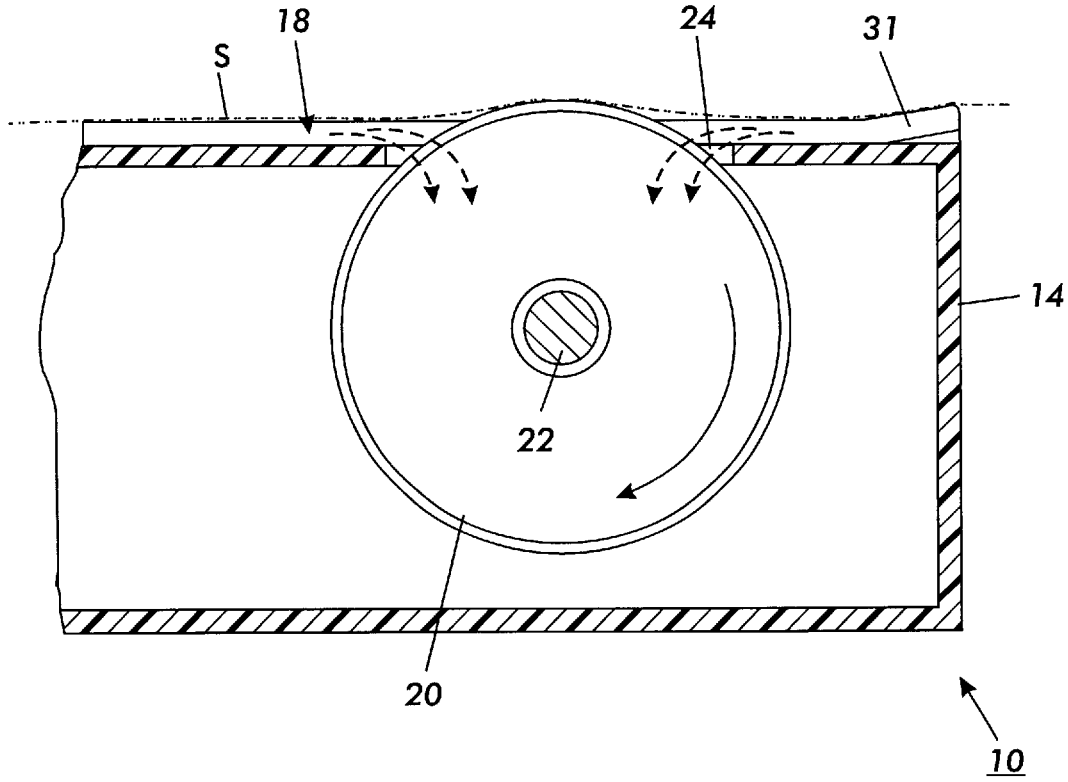
FIG. 2 is a simplified sectional view through line 2–2 of the vacuum transport shown in FIG. 1.

FIG. 2 a is a simplified elevational view through the line marked 2–2 in FIG. 1, showing a detail of vacuum chamber 14. As can be seen in FIG. 2, there is partially disposed within vacuum chamber 14 a plurality of rollers, one of which is shown as 20 in FIG. 2, all of which are preferably disposed on a single axle 22. As can be seen in FIG. 2, a portion of each roller 20 protrudes through an opening 24 defined in the surface 18. As can be seen in FIG. 1, preferably each of these rollers 20 has defined around the circumference thereof at least one groove. The axle 22 may in turn include a pick up gear, such as shown as 26 in FIG. 1, which in turn would contact a driver gear (not shown) within the machine itself.

When a partial vacuum is created within vacuum chamber 14, such as by applying a vacuum through opening 16, air will flow between an outer surface of each roller 20 and the edges of the corresponding opening 24, as well as through any grooves which are defined around the circumference of each roller 20. This airflow into the vacuum chamber 14 is helpful in causing a sheet, such as indicated as S, in contact with the surface of the rollers 20 to maintain a relatively firm contact with the rollers 20 and also, generally, the surface 18 of the vacuum transport 10. When a sheet is in such contact with the rollers 20 and the surface 18, and the rollers 20 are caused to rotate such as via axle 22 and the gear 26, the sheet will be directed from the photoreceptor to a fuser.

In the preferred embodiment of the present invention, the rollers 20 are distributed to be concentrated toward one end of the full width of the paper path formed by surface 18. As can be seen in the Figure, four rollers 20 are disposed toward one end of the paper path, with only two other rollers, indicated as 21 in FIG. 1, disposed along the rest of the width of the paper path. The purpose of distributing rollers 20, 21 in this way is to provide a vacuum transport which is particularly useful in transporting relatively small sheets, such as index cards. Typically, with larger sheet sizes, a leading edge of the sheet will enter the fuser while another trailing portion of the sheet is still attached to the photoreceptor, and in such a case misfeeding or jamming is unlikely. However, small sheets, which do not occupy the full width across the vacuum transport 10, will have a similarly short dimension along the process direction P, and these small sheets are particularly vulnerable to misfeed between the photoreceptor and fuser. Therefore, particularly in the case of where the design of the printer is "edge-registered," (i.e., where the sheets regardless of size are urged against one edge of the paper path as opposed to being centered along the paper path), it is desirable to have more openings such as 24 along those portions of the width of the paper path over which the smaller sheets will pass. Indeed, in a preferred embodiment of a printer according to the present invention, the vacuum is applied to vacuum chamber 14 only when it is desired to feed smaller sheets; when feeding larger sheets (that is, sheets which occupy almost the full width across the paper path) no vacuum is applied.

Also shown on the surface 18 of vacuum transport 10 in FIG. 1, is a plurality of ribs, or fins, which are oriented along the process direction P over which sheets pass over the vacuum transport 10. These ribs, generally indicated in FIG. 1 as 30, are preferably evenly spaced across the full width of the surface 18, and, where the openings 24 for rollers 20 are concentrated, the ribs are disposed between adjacent pairs of rollers 20.

Figure 3:
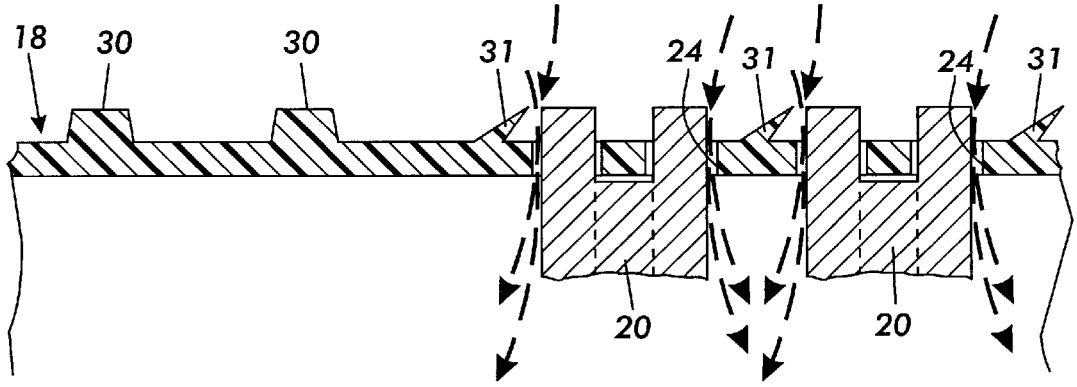
FIG. 3 is a simplified sectional view through line 3–3 of the vacuum transport shown in FIG. 1.

According to a preferred embodiment of the present invention, the geometry of the ribs is different for those ribs which are disposed adjacent to rollers 20, as opposed to other ribs, particularly where the rollers 20 are concentrated toward one end of the width of the paper path. FIG. 3 is a partial sectional view through line 3–3 shown in FIG. 1. As can be seen in the Figure, where rollers 20 protrude through openings 24, the ribs 31 are configured to extend diagonally from the surface 18 generally toward one end of the width of the paper path, as shown by the geometry of ribs 31, as opposed to the relatively symmetrical geometry of ribs 30 which are disposed along the balance of the width of the paper path. The purpose of this special geometry of ribs 31 is to ensure that the top and/or bottom edge of any sheet cannot coincide with any immediate edge offered by the geometry of rib type 30.

Figure 4:
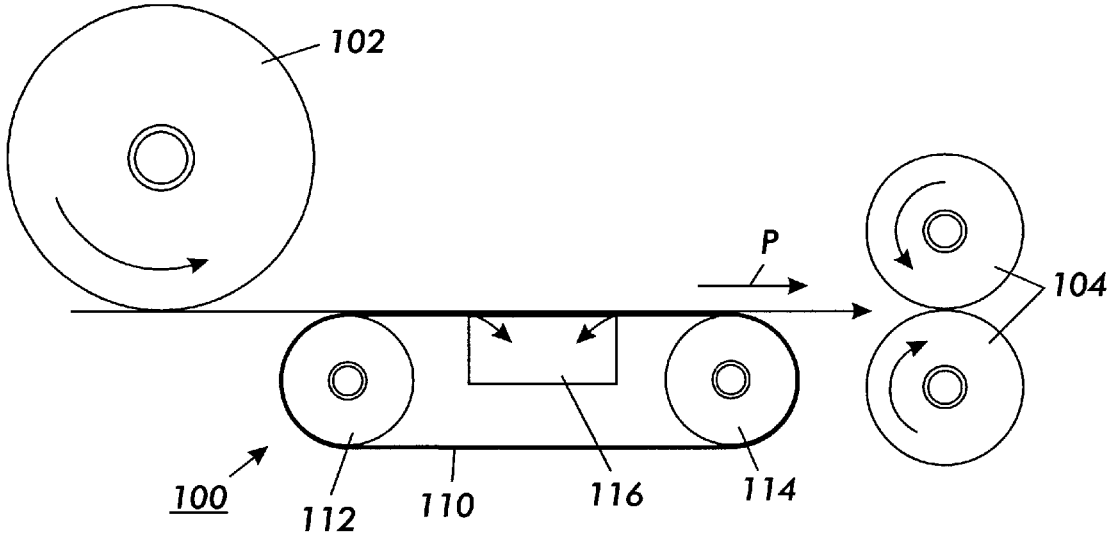
FIG. 4 PRIOR ART
FIG. 4 is a simplified elevational view showing of the function of a vacuum transport of the prior art in the context of an electrostatographic printer.

Although the preferred embodiment of the invention is especially useful for transporting sheets within an electrophotographic printing apparatus, such as in the position shown in FIG. 4, the invention as claimed can be useful in other types of printers, such as an ink-jet printer, or within other types of sheet-handling equipment.

What is claimed is:

1. A vacuum transport for conveying a sheet in a process direction within a printing apparatus, comprising:

means defining a chamber, the chamber defining an external surface, the external surface defining a full width perpendicular to the process direction;

a first plurality of openings defined in the external surface;

a first plurality of ribs protruding from the external surface, the ribs being disposed between pairs of openings of the first plurality of openings, the ribs being oriented along the process direction;

an axle rotatably mounted within the chamber;

a plurality of rollers disposed on the axle, whereby a portion of each roller protrudes through one of the first plurality of openings.

2. The vacuum transport of claim 1, further comprising means for creating a partial vacuum within the chamber.

3. The vacuum transport of claim 2, further comprising means for activating the means for creating a partial vacuum within the chamber only when a sheet of smaller than a predetermined size is desired to be transported over the external surface.

4. The vacuum transport of claim 1, each roller of the first plurality of rollers including a groove defined around a circumference thereof.

5. The vacuum transport of claim 1, the first plurality of openings being disposed mainly toward one end along the full width of the external surface.

6. The vacuum transport of claim 1, the first plurality of ribs protruding substantially diagonally and directed toward an end of the full width of the external surface.

7. The vacuum transport of claim 6, further comprising a second plurality of ribs, the second plurality of ribs being disposed on the external surface, oriented along the process direction, and substantially not associated with the first plurality of openings.

8. The vacuum transport of claim 7, the first plurality of ribs protruding substantially diagonally and directed toward an end of the full width of the external surface, and the second plurality of ribs substantially not protruding diagonally.

9. A vacuum transport for conveying a sheet in a process direction within a printing apparatus, comprising:

means defining a chamber, the chamber defining an external surface, the external surface defining a full width perpendicular to the process direction;

a first plurality of openings defined in the external surface;

a first plurality of ribs protruding from the external surface, the ribs being disposed between pairs of openings of the first plurality of openings, the ribs being oriented along the process direction;

an axle rotatably mounted within the chamber;

a plurality of rollers disposed on the axle, whereby a portion of each roller protrudes through one of the first plurality of openings.

10. The printing apparatus of claim 9, further comprising means for creating a partial vacuum within the chamber.

11. The printing apparatus of claim 10, further comprising means for activating the means for creating a partial vacuum within the chamber only when a sheet of smaller than a predetermined size is desired to be transported over the external surface.

12. The printing apparatus of claim 9, each roller of the first plurality of rollers including a groove defined around a circumference thereof.

13. The printing apparatus of claim 9, the first plurality of openings being disposed mainly toward one end along the full width of the external surface.

14. The printing apparatus of claim 9, the first plurality of ribs protruding substantially diagonally and directed toward an end of the full width of the external surface.

15. The printing apparatus of claim 14, further comprising a second plurality of ribs, the second plurality of ribs being disposed on the external surface, oriented along the process direction, and substantially not associated with the first plurality of openings.

16. The printing apparatus of claim 15, the first plurality of ribs protruding substantially diagonally and directed toward an end of the full width of the external surface, and the second plurality of ribs substantially not protruding diagonally.

17. The printing apparatus of claim 9, wherein the vacuum transport is operatively disposed between a photoreceptor and a fuser.

* * * * *